US006616505B1

(12) United States Patent
Reagan et al.

(10) Patent No.: US 6,616,505 B1
(45) Date of Patent: Sep. 9, 2003

(54) MODEL TRAIN SOUND BOARD INTERFACE

(75) Inventors: Michael P. Reagan, 7165 Locust Ave., Apt. #10, Boardman, OH (US) 44512; Louis H. Niederlander, Richfield, OH (US)

(73) Assignee: Michael P. Reagan, Boardman, OH (US)

( * ) Notice: Subject to any disclaimer, the term of this patent is extended or adjusted under 35 U.S.C. 154(b) by 0 days.

(21) Appl. No.: 09/389,255

(22) Filed: Sep. 3, 1999

Related U.S. Application Data

(60) Provisional application No. 60/099,275, filed on Sep. 4, 1998.

(51) Int. Cl.[7] ..... A63H 19/02
(52) U.S. Cl. ..... 446/467; 446/454
(58) Field of Search ..... 446/454, 455, 446/456, 467, 410, 175; 104/295, 297; 247/187 A

(56) References Cited

U.S. PATENT DOCUMENTS

| | | | | | |
|---|---|---|---|---|---|
| 2,138,367 | A | | 11/1938 | Bonanno | |
| 2,155,343 | A | * | 4/1939 | Bonanno | 104/149 |
| 2,172,468 | A | | 9/1939 | Giaimo | |
| 2,202,546 | A | | 5/1940 | Bonanno | |
| 2,622,542 | A | | 12/1952 | Bonanno | |
| 4,914,431 | A | | 4/1990 | Severson et al. | |
| 5,184,048 | A | | 2/1993 | Severson et al. | |
| 5,251,856 | A | * | 10/1993 | Young et al. | 246/4 |
| 5,267,318 | A | | 11/1993 | Severson et al. | |
| 5,394,068 | A | | 2/1995 | Severson et al. | |
| 5,441,223 | A | * | 8/1995 | Young et al. | 246/4 |
| 5,448,142 | A | * | 9/1995 | Severson et al. | 318/280 |
| 5,492,290 | A | | 2/1996 | Quinn et al. | |
| 5,555,815 | A | | 9/1996 | Young et al. | |
| 5,590,856 | A | | 1/1997 | Quinn et al. | |
| 5,633,985 | A | | 5/1997 | Severson et al. | |
| 5,749,547 | A | * | 5/1998 | Young et al. | 246/4 |
| 5,773,939 | A | | 6/1998 | Severson et al. | |
| 5,832,431 | A | | 11/1998 | Severson et al. | |
| 5,855,004 | A | * | 12/1998 | Novosel et al. | 704/272 |
| 5,896,017 | A | * | 4/1999 | Severson et al. | 312/280 |
| 6,014,934 | A | * | 1/2000 | Pierson | 105/26.05 |
| 6,281,606 | B1 | * | 8/2001 | Westlake | 307/125 |
| 6,247,994 | B1 | * | 6/2002 | DeAngelis | 446/454 |

OTHER PUBLICATIONS

W. K. Walthers, "Toy, Tinplate & Scale Model Railroads—A Manual For Tinplaters," 2nd Printing, Wm K. Walthers, Inc. (Milwaukee, WI) (Mar. 1958) (4 pages).

* cited by examiner

*Primary Examiner*—Derris H. Banks
*Assistant Examiner*—Kurt Fernstrom
(74) *Attorney, Agent, or Firm*—Hahn Loeser + Parks, LLP

(57) ABSTRACT

The present invention is a model train sound board interface for making model trains compatible with the LIONEL TRAINMASTER® Command Control system. The model train sound board interface is comprised of circuitry which interprets serial digital data received from the LIONEL TRAINMASTER Command Control transmitter to determine what command the user is sending to the model train engine. Once the command is interpreted the circuitry provides the appropriate output signal to carry out the command.

The circuitry of the preferred embodiment includes a microprocessor for interpreting serial data from the LIONEL TRAINMASTER Receiver, negative 5 and approximately negative 9 volt power supplies for providing consistent and filtered power to external sound boards, an H-bridge triac motor driver optically coupled to the microprocessor and DC offset circuitry made up of variable voltage regulators, again optically coupled to the microprocessor. The DC offset circuitry provides positive and negative DC offsets required by many popular aftermarket sound boards for model trains which provide life-like sound effects.

5 Claims, 4 Drawing Sheets

MODEL TRAIN SOUND BOARD INTERFACE

This application claims the benefit of U.S. Provisional Application No. 60/099,275 filed Sep. 4, 1998. The present invention relates to model trains and more specifically to a model train sound board interface which allows a user to operate model train engines using an industry standard command controller device. The interface allows the user to run multiple model trains on the same track while being able to control a number of features such as sound effects and future improvements.

BACKGROUND OF THE INVENTION

Model train sets typically include an electrically driven model train engine which receives power from a voltage applied to the tracks and picked up by the train's electric motor. A transformer is typically used to apply the power to the tracks. The transformer is used to control the amplitude and polarity of the voltage, which in turn controls the speed and direction of the model train. In 2-rail O gauge, HO and N gauge systems, the voltage is a DC voltage. In 3-rail O gauge LIONEL systems, the voltage is an AC voltage, i.e., the 60 Hz line voltage available from a standard wall socket, stepped down by the transformer to not more than 24 volts.

Model train enthusiasts also have a desire to control other features of the train besides speed and direction. For example, users may wish to control the blowing of a whistle. To control the whistle LIONEL trains impose a DC voltage on top of the AC line voltage, which the electric engine then detects. One limitation to this method is in the number of controls that can be transmitted, since there are only plus and minus DC levels available, along with varying amplitudes.

LIONEL trains originally used a mechanical lever on the engine to reverse the direction of the model train because AC electric motors do not change direction with voltage polarity reversal as applied to the track. LIONEL subsequently introduced the E-Unit which allowed a certain degree of remote control over the direction of the train. The E-Unit is typically mounted on the engine and has a solenoid coil that is powered from the track. Upon the momentary removal of power from the track, the solenoid coil releases and the solenoid plunger dislodges a pawl or pivoting arm away from a ratchet tooth of a drum. When power is restored to the solenoid, the plunger is withdrawn upward until the pawl catches the tooth on the drum rotating it to the next state. The drum has spring contacts which connect to the track power and the electric motor. The contacts switch as the drum is rotated to change the connections of the motor armature with respect to the motor field. The rotating drum sequences the electric motor through the following states: forward, neutral before reverse, reverse, and neutral before forward.

Although a monumental improvement, the E-Unit suffered from the disadvantage that it controlled the model train by removing power. Dirty tracks and loose connections can unintentionally cause unwanted power interruptions. In turn, these interruptions can cause the E-Unit to change its state without being requested to do so by the user. Another disadvantage to the E-Unit was that it required the solenoid to be on continuously when power is applied to the track. This causes in a continuous buzzing by the E-Unit during operation which also was a waste of power. The buzzing noise is caused by the AC field of the electric motor vibrating the plunger as the polarity of the AC field alternates.

To solve the problems associated with the E-Unit a control system with a modified E-Unit was developed. The modified control system operates by sending control signals to the model train itself, rather than by interrupting power to the train track. One disadvantage to this system was that a model train designed for the modified control system will not operate on old train tracks which control the model train through momentary power interruptions.

To improve on the modified control system, a control circuit was developed that would momentarily apply power to an E-Unit solenoid upon detecting a momentary power interruption. After the E-Unit drum advances, power is removed from the solenoid allowing the plunger to drop and dislodge the pawl. This position represents the rest state of the E-Unit. In the rest state power is removed from the E-Unit eliminating any noise. The E-Unit is then ready for movement into the next state. The dislodging of the pawl is the first half of the rotation operation which is done ahead of time. The first half of the rotation nonetheless does not change the contact position. The contact position then occurs when power is reapplied causing the plunger to be drawn up causing the drum to rotate.

This prior art model train control system is known as the TRAINMASTER® Control System (TCC) which is sold by LIONEL. The TrainMaster Control System sold by LIONEL is disclosed in U.S. Pat. Nos. 5,251,856 and 5,441,223 to Young et al., both hereby incorporated in this written description by reference. The TCC also provides a remote control device used to transmit signals to a base unit connected between the transformer and the train track. The base unit then transmits signals to particular engines using a digital address imposed upon the track power signal. The TCC remote control device uses frequency shift keying (FSK) modulation to transmit information from the transmitter to the model train engines. Each model train engine is equipped with a receiver having a particular digital address. The information received by the model train engine controls the operation of the train including its direction. One of the benefits to the LIONEL TCC is that it can be used to override the model train's connection to the modified E-Unit. This allows remote control to be used independent of track power and backward compatibility for model train sets that use track power interruptions to control standard E-Units.

Today, one of the biggest draw backs to the LIONEL TCC system is that there is no way to add TCC to an existing model train not already properly equipped by LIONEL. There have been no aftermarket products available which would allow the addition of the LIONEL TRAINMASTER Command Control to existing model trains. Because of this lack of aftermarket conversion products many model trains become useless on a TCC train track. Many train enthusiasts have invested significant amounts of money in older, non TCC model trains and therefore are hesitant to switch to the TCC system despite its superior performance and characteristics.

Therefore, in light of the foregoing deficiencies in the prior art, the applicant's invention is herein presented.

SUMMARY OF THE INVENTION

The present invention provides a model train sound board interface for making model trains compatible with the LIONEL TRAINMASTER Command Control (hereinafter referred to as "Command Control") system. The model train sound board interface of the present invention, also referred to as a Universal Command Upgrade Board (hereinafter referred to as "UCUB"), can be retrofit in model trains in order to upgrade all 3-rail model train engines for use with Command Control.

In one embodiment of the present invention, the model train sound board interface is comprised of circuitry which interprets serial digital data received from the LIONEL TRAINMASTER Command Control transmitter to determine what command the user is sending to the model train engine. Once the command is interpreted the circuitry provides the appropriate output signal to carry out the command. The circuitry of the preferred embodiment includes a microprocessor for interpreting serial data from the LIONEL TRAINMASTER Receiver, purchased separately from Lionel and known in the industry as the "R2LC". The R2LC receiver is connected to the microprocessor through a standard connector included with the model train interface.

Also included in the preferred embodiment are negative 5 and approximately negative 9 volt power supplies for providing consistent and filtered power to some external sound boards, an H-bridge triac motor driver optically coupled to digital output ports on the R2LC receiver and DC offset circuitry comprised of variable voltage regulators again optically coupled to the UCUB microcontroller. While the model train sound board interface can be configured to control just about any function of the model train, in the preferred embodiment the interface is configured to provide control of speed, direction and sound effects. In particular, the DC offset circuitry provides positive and negative DC offsets required by many popular aftermarket sound boards for model trains which provide life-like sound effects.

These along with other objects and advantages of the present invention will become more readily apparent from a reading of the detailed description taken in conjunction with the drawings and the claims.

DETAILED DESCRIPTION OF THE PREFERRED EMBODIMENT

Figure 1:
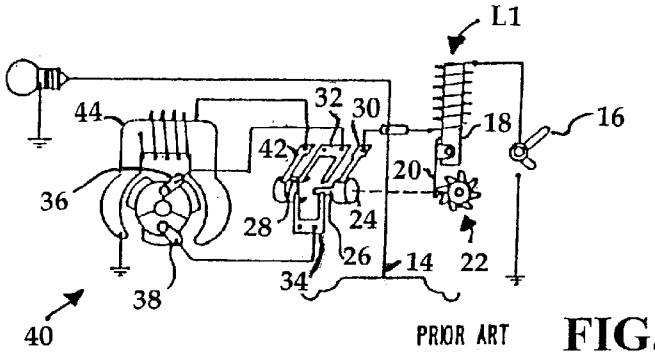
PRIOR ART FIG. 1
FIG. 1 is a schematic diagram of an E-Unit according to the prior art.
Figure 2:
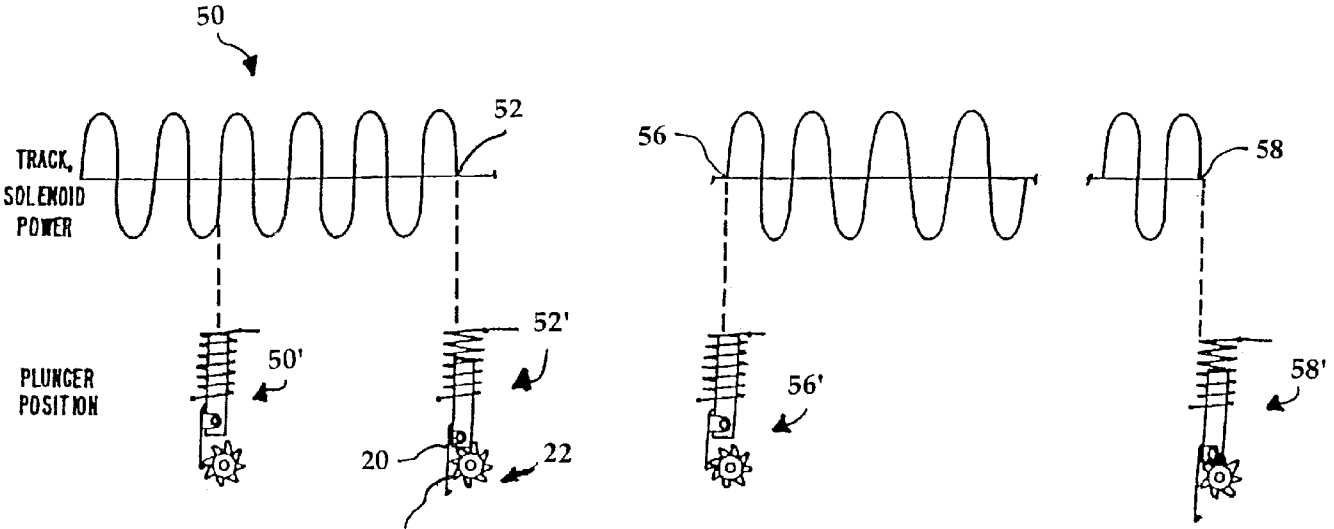
PRIOR ART FIG. 2
FIG. 2 is a timing diagram illustrating the position of the plunger of the E-Unit during the removal and application of track power according to the prior art.
Figure 3:
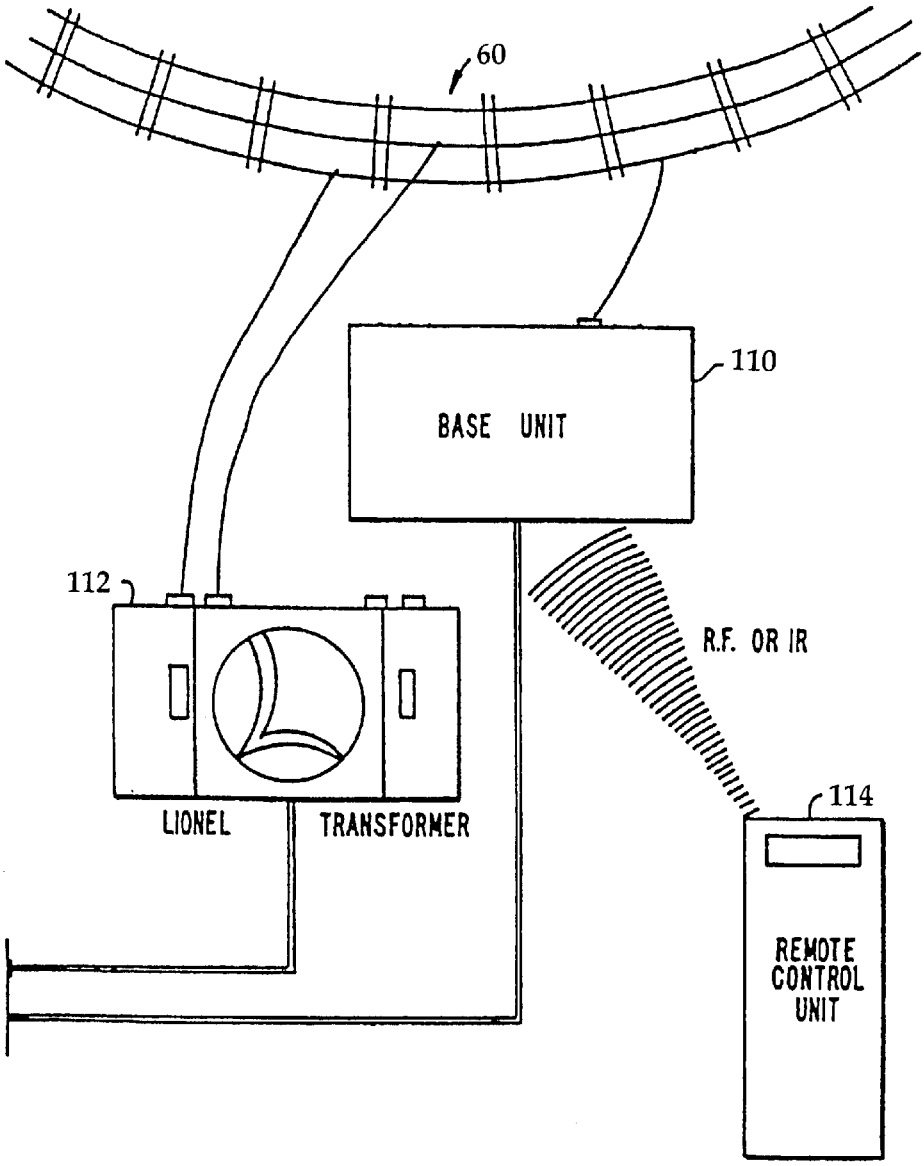
FIG. 3 is a block diagram of the transmitter and base unit of the industry standard command controller device according to the prior art.

The prior art shown in FIGS. 1–3 is represented and described in U.S. Pat. No. 5,251,856 to Young, et al. as follows: FIG. 1 is a schematic diagram of a standard E-Unit found in the prior art. An E-Unit coil L1 receives power from contact sliders 14 which pass through the coil to ground through a manual override switch 16. When power is applied, a plunger 18 is pulled up within E-Unit coil L1. When power is removed, plunger 18 will descend, forcing pawl 20 away from ratchet assembly 22. This will cause the pawl 20 to disengage a tooth of ratchet assembly 22, so that when power is applied again and plunger 18 is removed, ratchet assembly 22 will rotate to the next tooth which will be engaged by pawl 20.

This rotation rotates a drum 24 physically connected to the ratchet. Drum 24 has different contact regions on its face, such as contacts 26 and 28. These contacts connect with various spring contacts biased against the drum depending upon the position. Power is applied through a first contact 30. Contacts 32 and 34 are connected to brushes 36 and 38 of motor 40. Contact 42 is connected to the motor field winding 44. As plunger 18 moves up and down, it rotates ratchet wheel assembly 22, rotating drum 24 and changing the connection to the motor to move it from forward, to neutral, to reverse, and back to neutral again.

FIG. 2 is a timing diagram illustrating the position of the plunger in FIG. 1 with respect to the applied power to the track and the solenoid. In a first time period 50, AC power is applied, and the plunger is in an up position as illustrated by plunger diagram 50'. A power interruption between times 52 and 56 is used to switch the E-Unit. When power is removed at a time 52, the plunger drops down as shown in plunger diagram 52' due to the removal of power. This causes pawl 20 to become disengaged from tooth 54 of ratchet wheel assembly 22. At this point, no connections have been changed, the pawl 20 has simply been disengaged.

When power is reapplied at a time 56, the plunger is retracted to the position shown in 56', with the pawl pulling on a tooth of ratchet wheel assembly 22 to rotate the ratchet wheel. This rotation causes the change in connections to the motor, from forward to neutral, for example. At a time 58, power is removed again, causing the plunger to drop again as shown in position 58'. To move the train from forward to reverse, for example, power must be interrupted twice, the first interruption will cause the ratchet wheel to move one position from forward to neutral, and the second power interruption will move the ratchet wheel again from neutral to reverse.

FIG. 3 shows a block diagram of the LIONEL TRAINMASTER Command Control connected to the tracks 60. A base unit 110 is connected to the tracks in the standard configuration for LIONEL transformer 112. A remote control unit 114 transmits radio frequency, infrared or other signals to base unit 110. Base unit 110 combines an FSK (frequency shift keyed) signal with the power signal applied to track 60 to send an address and data signal to a power block of the track. The addressed train on that power block will receive and decode the signal. In an alternate embodiment, remote control unit 114 could transmit signals directly to a receiver located within the model train engine.

Primary Components and Operation of Model Train Sound Board Interface

Figure 4:
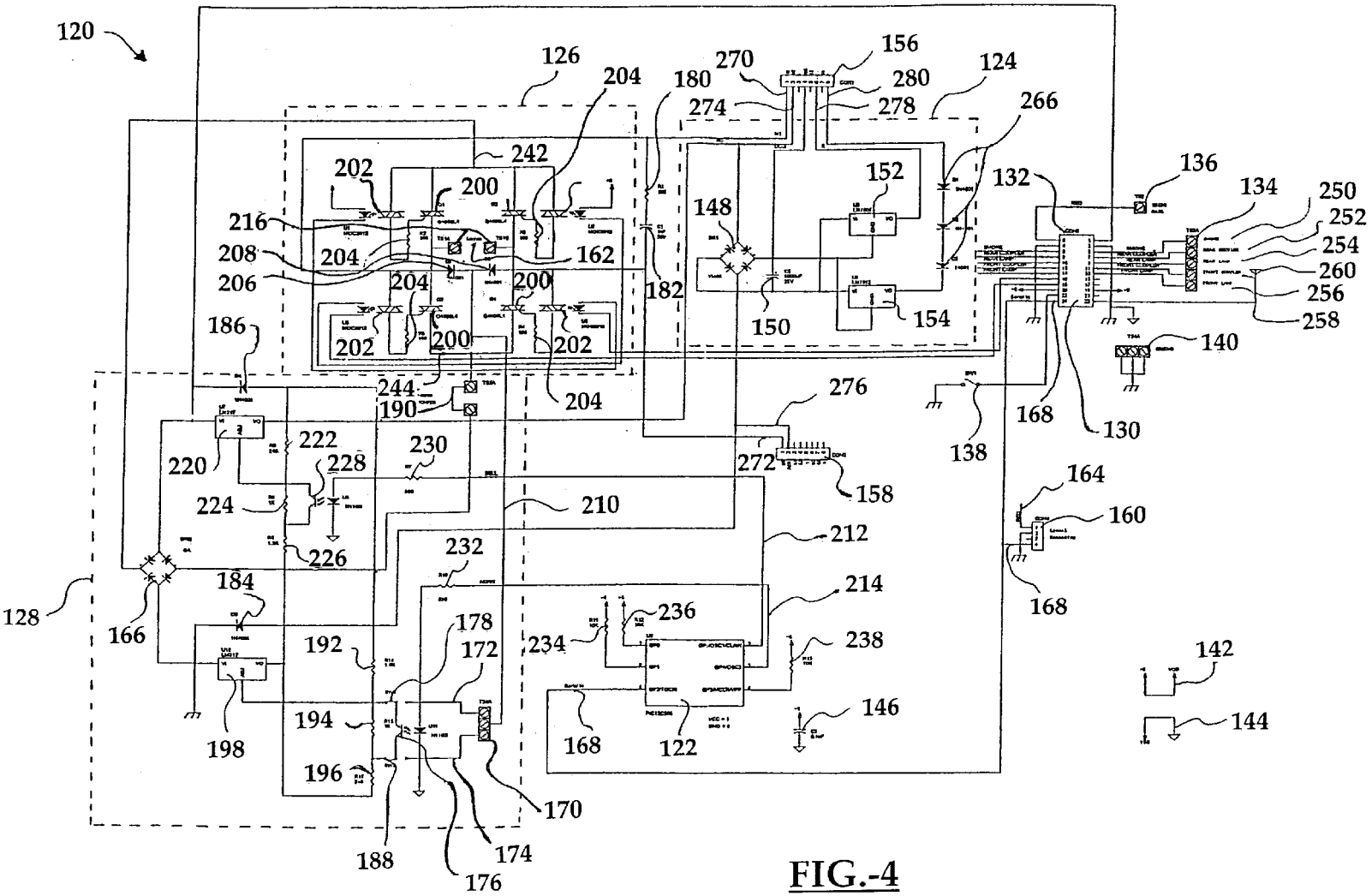
FIG. 4 is an electrical schematic diagram of the model train sound board interface of the present invention.

FIG. 4 shows an electrical schematic diagram of the model train sound board interface 120 of the present invention. Model train sound board interface 120 is primarily comprised of microcontroller 122, negative DC power supply 124, motor driver 126, DC offset circuit 128 and R2LC receiver 130. An essential component to interface 120, R2LC receiver 130, known in the industry as the LIONEL TRAINMASTER Receiver, receives commands sent by the model train enthusiast from the LIONEL TRAINMASTER Command Control transmitter 114 (shown in FIG. 3). The LIONEL TRAINMASTER Command Control system can transmit commands to the model train over the tracks 60 once base unit 110 receives the commands from the transmitter 114. The R2LC receiver 130 captures the transmitted commands via antenna 260 which is connected to R2LC receiver 130 through 24-pin connector 132 of model train sound board interface 120. The a TRAINMASTER Control System, including transmitter 114 and receiver 130 are disclosed in U.S. Pat. Nos. 5,251,856 and 5,441,223 to Young et al., both of which are hereby incorporated in this written description by reference.

R2LC receiver 130 comes equipped with a serial port 168 which outputs a digital serial data stream that corresponds to each command received from transmitter 114. In addition, R2LC receiver 130 has a number of direct digital outputs used to control standard functions on the model train engine. The standard digital outputs are used to control the following functions: smoke 250, rear coupler 252, rear lamp 254, front coupler 256 and front lamp 258. Model train sound board interface 120 includes a means for connecting the R2LC digital outputs to their respective mechanisms within the model train engine. In the preferred embodiment, the connecting means is terminal block 134 which allows wires to be inserted and tightened within the terminal block 134 by a screw retaining device. The connecting means could also be comprised of various electrical connectors having male-female connections, spring loaded clamping devices, or even individual connectors for each digital output. As space within the model train engine is limited the connecting means could simply consist of solder pads to which wires are attached directly.

A number of other connecting means are disclosed and described throughout this specification as terminal blocks. The aforementioned alternatives to terminal blocks as connecting means apply to each terminal block shown as part of the present invention and therefore will not be repeated throughout. Some of the other terminal blocks are used to connect external circuits and/or devices to the 18 VAC power supply 136 provided by the third rail of the 3-rail train track 60 (shown in FIG. 3), and ground (GND) terminal block 140. In 3-rail O gauge model train systems, the voltage is an AC voltage, i.e., the 60 Hz, 120 VAC line voltage available from a standard wall socket. A transformer 112 (shown in FIG. 3) is then used to reduce the voltage to approximately 18 VAC which is supplied to the center of the three rails of the track 60, or what is typically referred to as the "third rail". The other two rails of the three-rail track 60 are connected together and provide the neutral connection necessary to provide power to the model train system. As will be described in more detail throughout the written description, the 18 VAC is conditioned in a number of different ways and used for providing power to the model train motor 162 and providing input voltages to several different voltage rectifiers. Once the AC voltage passes through a rectifier the resulting DC voltage is filtered and regulated to provide DC voltages. In particular, the digital circuitry incorporated within model train sound board interface 120 is operated on +5 VDC (VDD) 142 and GND (VSS) 144. While a number of DC voltages, as explained later, are rectified and regulated directly on the model train sound board interface 120, the +5 VDC is actually provided to circuitry on interface 120 from R2LC receiver 130. The R2LC receiver 130 includes a +5 VDC power supply rated for approximately 30 mA which is sufficient to power microcontroller 122 and the optically isolated triac drivers 202. If desired an independent +5 VDC power supply could just as easily been incorporated directly within model train sound board interface 120.

One of the reasons that the TRAINMASTER Command Control ("TCC") is the dominant model train system among enthusiasts is its ability to allow more than one model train engine to be operated and controlled on the same track at the same time. To accommodate multiple model train engines each R2LC receiver 130 is programmed with a unique digital address. During operation of multiple model train engines each R2LC receiver 130 decodes all signals sent from transmitter 114. As part of each command transmitter 114 includes a digital address that is unique to one of the multiple model train engines. In this way the appropriate model train engine knows when to obey a transmitted command or ignore the command. In order to allow the R2LC receiver 130 to be programmed for a specific digital address, model train sound board interface 120 includes PROGRAM/RUN switch 138 coupled to a digital input of R2LC receiver 130 through connector 132.

When switch 138 is open the digital input of R2LC receiver 130 is pulled high. When R2LC receiver 130 detects a high on its program/run digital input it knows that the model train engine is in the RUN mode and that received commands should be interpreted and followed for normal operation of the model train engine. When switch 138 is closed the digital input of R2LC receiver 130 is pulled low by circuitry external to R2LC receiver 130. R2LC receiver 130 knows that the model train engine, and more specifically the R2LC receiver 130 itself, is now in the PROGRAM mode. R2LC receiver 130 now allows the user to reprogram its digital address via transmitter 114 as desired. For the remainder of this written description PROGRAM/RUN switch 138 is in the open position or the RUN mode.

Motor Driver Circuit for Speed and Direction Control

As previously mentioned, the model train sound board interface 120 includes motor driver 126 which allows a user to control the speed and direction of the model train engine using the TRAINMASTER Command Control system. Motor driver 126 is comprised of an H-bridge primarily made up of triacs 200 and optically isolated triac drivers 202. In one preferred embodiment, the triacs 200 are three-terminal bidirectional semiconductor devices designed for AC switching and phase control applications such as speed modulation control. The triggering signal is normally applied between the gate and terminal MT1. While the necessary electrical specifications can vary, in the preferred embodiment triacs 200 have an RMS on-state current conduction angle of 360 degrees with a maximum current rating of 8 amps and a repetitive peak blocking voltage of 400 volts. Triacs meeting these electrical specifications are available from a number of manufacturers. One particular manufacturer is Teccor Electronics who manufactures and sells triacs having the electrical specifications set forth under part number Q4008L4. One of ordinary skill in the art will know that the particular triac component described could be substituted by a plurality of components. Applicant contemplates the use of other components and is not limited to the specific part described. Unless specifically noted otherwise, this applies to all of the electrical and/or electronic components disclosed and described in the written description and attached figures.

In the preferred embodiment, optically isolated triac drivers 202 contain a GaAs infrared emitting diode and a light activated silicon bilateral switch, which functions like a triac. The optically isolated triac driver 202 is designed for interfacing between electronic controls and power triacs such as triacs 200. One particular manufacturer is QT Optoelectronics who manufactures and sells optically isolated triac drivers having the electrical specifications set forth under part number MOC3012. Again, referring to FIG. 4 and motor driver 126, four triacs 200 and four optically isolated triac drivers 202 are configured into an H-bridge. For ease of reference, each triac 200 will be referred to as Q1–Q4, respectively, and each optically isolated triac driver 202 will be referred to as U1–U2 and U5–U6, respectively, as shown in FIG. 4.

The H-bridge provides a means for changing the direction of current flow and/or magnetic field in order to control the speed and direction of either a DC or an AC electric motor Depending on the type of model train engine used its motor 162 could be either AC or DC. The H-bridge in cooperation with additional circuitry of the model train sound board interface 120 allow for universal compatibility with both AC and DC model train electric motors. The configuration of the H-bridge will now be described in more detail. Each side of the H-bridge consists of two triacs 200. The left side of the H-bridge is made up of triac Q1 and triac Q3 which are connected in series. The right side of the H-bridge is made up of triac Q2 and triac Q4 which are also connected in series. Connected between each set of triacs, Q1–Q3 and Q2–Q4 respectively, is one of two connections of terminal block 216. Electric motor 162 of the model train engine is connected between each of the two connections of terminal block 216 thereby connecting motor 162 between the H-bridge. The remaining terminals of triacs Q1 and Q2 are connected together as are the remaining terminals of triacs Q3 and Q4. The electrical node connecting Q1 with Q2 is considered positive voltage input 242 for DC motors or hot voltage input 242 for AC motors. The electrical node connecting Q3 and Q4 is considered ground 244 for DC motors or neutral 244 for AC motors. Input 242 is coupled to the positive output of diode rectifier bridge 166 and input 244 is coupled to the negative output of diode rectifier bridge 166. Bridge 166 provides full-wave rectification of the 18 VAC track voltage provided to its inputs from third rail 136 and ground 140.

To complete the H-bridge each triac 200 is connected to an optically isolated triac driver 202 which allows microcontroller 122 to control the on and off cycling of each triac 200 without being exposed to the increased voltages and currents controlled by triacs 200. As described above, each optically isolated triac driver 202 includes a GaAs infrared emitting diode and a light activated silicon bilateral switch, which functions like a triac. Each triac 200 includes an optically isolated triac driver 202 having one terminal connected to either input 242 or input 244 respectively, with the other terminal of driver 202 connected to the gate of triac 200 through a current limiting resistor 204. In the preferred embodiment, current limiting resistor 204 is a 100 ohm resistor.

The control over the H-bridge and its electrical components is provided by the electrical configuration of the infrared emitting diodes (also known as light emitting diodes or LEDs) incorporated within each optically isolated triac driver 202. The infrared emitting diodes of drivers U1 and U2 each have their anodes connected to +5 VDC. The cathode of the infrared emitting diode of driver U1 is then connected to the anode of the infrared emitting diode of driver U6. Similarly, the cathode of the infrared emitting diode of driver U2 is connected to the anode of the infrared emitting diode of driver U5. To complete the H-bridge control circuit, the cathode of the infrared emitting diode of driver U5 is connected to pin 18 of connector 132 and the cathode of the infrared emitting diode of driver U6 is connected to pin 16 of connector 132. Of course connector 132 electrically connects the cathodes of the infrared emitting diodes of drivers U5 and U6 to digital outputs from R2LC receiver 130. In response to the appropriate command from the TRAINMASTER Command Control transmitter 114, the digital outputs from R2LC receiver 130 would sequence between low and high (GND and +5 VDC) states which in turn controlled the H-bridge and motor 162.

To simplify the description, the H-bridge operation will be described when used with a DC motor 162. To begin, DC motor 162 will rotate in one direction when current flows in one direction and DC motor 162 will rotate in an opposite direction when the direction of current flow is reversed. To accomplish the reversal of current flow only two of the four triacs 200 that make up the H-bridge are activated at any one time. For example, in order for DC motor 162 to rotate in one direction, the digital outputs found at pins 16 and 18 of R2LC receiver 130 must have opposite states, i.e., one must be low and the other must be high. Assuming that pin 18 is high and pin 16 is low, the cathode to the LED of driver U5 will be high preventing current from flowing through the LED. This will prevent the bilateral switch within driver U5 from conducting thereby keeping triac Q3 from conducting. Because the cathode to the LED of driver U2 is tied to the anode of the LED of driver U5, the bilateral switch within driver U2 will not conduct and triac Q2 will also remain off.

While triacs Q2 and Q3 remain turned off thereby preventing current flow, triacs Q1 and Q4 are turned on thereby allowing current to flow in one direction through triac Q1, through DC motor 162 and then through triac Q4 to ground to complete the current path. As set forth above, assuming pin 16 from R2LC receiver 130 is low, the cathode of the LED of driver U6 will allow current to conduct through the LED. Because the anode of the LED of driver U6 is connected to the cathode of the LED of driver U1, current also conducts through the LED of driver U1. When current conducts through the LEDs each emits infrared light which activates its respective light activated bilateral switch. This in turn provides the required trigger current at the gates of triac Q1 and triac Q4 to cause each to go into a conductive state or to turn on. When triac Q1 and triac Q4 are both turned on and DC motor 162 is connected between terminals 216, current flows from positive input 242, through triac Q1, through DC motor 162, through triac Q4 and then to ground 244 thereby causing DC motor 162 to rotate in one direction.

To reverse the direction of rotation of DC motor 162, the output states of pin 16 and pin 18 from the R2LC receiver 130 need to be reversed, i.e., pin 18 is low and pin 16 is high. This will cause the LEDs of drivers U1 and U6 to turn off and the LEDs of drivers U2 and U5 to turn on. As described above, this will cause triac Q1 and triac Q4 to stop conducting or turn off and cause triac Q2 and Q3 to begin conducting. This will cause current to flow from positive input 242, through triac Q2, through DC motor 162, through triac Q3 and then to ground 244. The redirection of the current path causes current to flow in an opposite direction through DC motor 162 thereby causing it to rotate in an opposite direction. The current redirection of the H-bridge configuration allows for forward and reverse travel of the model train engine.

In order to use the model train sound board interface 120 with an AC motor 162, the jumper bridging AC/DC motor select terminal block 190 must be removed. Full-wave rectifier bridge 166 must also be removed for operation with AC motor 162. A jumper (not shown) is then added to connect the hot AC input to the positive DC output from the circuit connections left vacant due to removing bridge 166. A second jumper is also added to connect the neutral AC input to the negative DC output from the circuit connections from bridge 166. The AC motor 162 armature is still connected between motor terminal blocks 216 but the field coil associated with the AC motor 162, as one of ordinary skill in the art would understand, must be connected between AC/DC motor select terminal block 190. The sequencing of the LEDs of each optically isolated triac driver 202 (U1–U2 and U5–U6) and triacs 200 (Q1–Q4) remain the same as with a DC motor. In operation, current flow in the field coil (not shown) of AC motor 162 is in the same direction regardless of the direction of current flow through the armature (not shown) of AC motor 162. Since the current flow in the field coil is always in the same direction, the magnetic field is always the same direction. These characteristics simulate the permanent magnet of a DC motor. This allows the H-bridge circuit to be used to drive both DC and AC electric motors.

Whether the model train engine is equipped with an AC or DC electric motor, the speed of the motor is regulated by controlling the degree of the phase angle at which the triacs 200 are turned on and off. To increase the speed of the model train engine in either direction, the appropriate triacs 200 for the chosen direction are turned on sooner and left on longer or for a greater period of the AC phase angle. To decrease the speed of the model train engine, the appropriate triacs 200 are turned on for shorter periods of the AC phase angle. The phase angle control of the triacs 200 is well known to those of ordinary skill in the art and is commonly used to control model train engine speed.

DC Offset Circuit for Third Party Sound Board Control

Model train sound board interface 120 also includes DC offset circuit 128 which allows the user to control sound effect for the model train engine using the TRAINMASTER Command Control system. Specifically, the DC offset circuit 128 allows aftermarket sound boards made by QS Industries to be controlled by the TRAINMASTER Command Control system. The model train sound board interface 120 as set forth in the present invention can control sound boards or units currently sold by QS Industries including but not limited to those sold under the trademarks QS1, QS2, QS2+, and QS-3000. Interface 120 will also operate sound boards sold by Mike's Train House (MTH) sold under the trademark Protosounds. The MTH sound board is manufactured by QS Industries and therefore functions similarly to units those sold by QS Industries.

In the model train market today QS Industries is one the leading aftermarket sound board manufacturers. To date one draw back with the various sound boards manufactured by QS Industries is that they have been incompatible with the LIONEL TRAINMASTER Command Control system and vice versa. This lack of compatibility has primarily been due to the differences in power supply requirements and data communication methods between the two systems. As described previously,the TRAINMASTER Command Control system operates on a three rail track 60 powered by 18 VAC. In contrast, sound boards manufactured by QS Industries ("QSI") operate on 4 to 24 VAC, but optimally at 12 VAC. If greater than 12 VAC is detected by QSI sound boards on power-up, they will lock out power to protect internal circuitry which is designed for a gradual power up. In addition, for compatibility with older model train systems the QS Industries products control sound effects, such as the bell and whistle, by sensing DC voltage offsets on the AC input power. Because of the popularity of sound boards sold by QS Industries the present invention bridges the compatibility gap between the TRAINMASTER Command Control system and sound boards manufactured by QS Industries. Model train sound board interface 120 also allows for compatibility with older LIONEL RailSounds including Sound of Steam, RailSounds 1.0 and RailSounds 2.0.

It should also be noted that the model train sound board interface 120 of the present invention is also compatible with the newer LIONEL RailSounds sound systems (i.e., RailSounds versions 2.5, 3.0, and 4.0) and sound systems sold by OTT Machine Service. The circuitry and functions that allow for the operation of these sound systems will be described in more detail later in the written description.

Model train sound board interface 120 includes two QS Industries (and third party compatible units) sound board connectors 156 and 158 which electrically couple the sound board to the model train engine and the TRAINMASTER Command Control system. The QS Industries (hereinafter "QSI") sound boards monitor electric motor 162 (AC or DC) to determine its speed and direction. One terminal (TS1A) of motor terminal block 216 is connected to M1 270 of sound board connector 156. The other terminal (TS1B) of motor terminal block 216 is connected to M2 272 of sound board connector 158. Connected in parallel across M1 270 and M2 272 of motor terminal block 216 is a RC "snubbing" circuit consisting of 100 ohm resistor 180 in series with 1 uF capacitor 182. The RC circuit provides a load to the motor 162 (not shown) allowing it to dissipate any residual current flowing through the coils of motor 162 thereby providing smoother operation of motor 162. The QSI sound boards use this motor information to determine and then generate appropriate sound effects. For example, if the model train engine is speeding up then the QSI sound board (not shown) will generate an electronic reproduction of a genuine train as it sounds when speeding up. Sound boards described briefly herein and manufactured and sold by QSI are described in detail in U.S. Pat. Nos. 5,267,318; 5,633,985; 5,832,431; and 5,896,017, all of which are herein incorporated into this written description by reference.

The QSI sound boards (and third party compatible units) also require power-up at less than 12 VAC to operate correctly as opposed to the 18 VAC used by the TRAINMASTER Command Control system. The 12 VAC is supplied by DC offset circuit 128 as will be described shortly. The 12 VAC is coupled to the QSI sound board through AC 274 of sound board connector 156 and ACG 276 of sound board connector 158. Two other inputs are provided through sound board connector 156 to insure compatibility with units manufactured or modified by third parties to emulate QSI sound boards. In particular, sound boards sold by MTH operate on emitter coupled logic and therefore require negative operating voltages. To accommodate this need the model train sound board interface 120 includes negative DC power supply 124. The resulting −5 VDC 278 and −9 VDC 280 are coupled to the third party sound board through sound board connector 156.

Negative DC power supply 124 is comprised of full-wave diode bridge rectifier 148 coupled to the 12 VAC supplied to the QSI (and compatible units) sound boards. Connected across the rectified output of the full-wave diode bridge rectifier 148 is an electrolytic filter capacitor 150 which is used to flatten out the half cycles to create a DC voltage. Attached to the output of rectifier 148 and filter capacitor 150 are −5 volt regulator 152 and −12 volt regulator 154. Each regulator (152 and 154 respectively) has its ground terminal connected to the positive output of rectifier 148 and its input terminal connected to the negative output of rectifier 148. The −5 VDC output from voltage regulator 152 is then coupled to the QSI sound boards through sound board connector 156. In order to obtain approximately −9 VDC the output of voltage regulator 154 is connected to three diodes 266 in series. Each diode reduces the −12 VDC output of voltage regulator 154 by approximately 0.7 volts. The resulting output voltage is then coupled to the QSI sound board through sound board connector 156.

As previously mentioned, QSI sound boards (and compatible third party units) require 12 VAC power-up to operate correctly. In addition, the QSI sound boards monitor the AC track voltage looking for DC voltage offsets riding on the AC track voltage. If the QSI sound board detects a positive DC voltage offset it knows to sound the model train engine's whistle. If the QSI sound board detects a negative DC voltage offset it knows to sound the model train engine's bell. Again, the reason for detecting DC voltage offsets riding upon the AC track voltage is due to the early development of model train sets. Many older model train engines operate the bell and whistle functions by detecting DC voltage offsets. By detecting the DC voltage offsets compatibility is maintained with older model train sets while still allowing enthusiasts to upgrade their sets using modern sound boards.

In this same spirit, the model train sound board interface 120 of the present invention provides further compatibility between older train sets, modern sound boards and the TRAINMASTER Command Control system. To allow QSI and compatible sound boards to operate at all model train sound board interface 120 converts the 18 VAC supplied by the third rail 136 of track 60 into 12 VAC. The 18 VAC is provided as an input voltage to two 3-terminal adjustable regulators 220 and 198 respectively. While 3-terminal adjustable regulators are well know to those of ordinary skill in the art, the preferred embodiment uses two National Semiconductor LM317 1.2V–25V adjustable regulators. In order to provide 12 VAC, the input of regulator 220 receives the positive half cycles of the 18 VAC track voltage while the input of regulator 198 receives the negative half cycles of the 18 VAC track voltage. The result is that regulator 220 provides a positive output voltage that resembles the positive half cycles of the 18 VAC track voltage except that they are clipped at approximately 12 volts. Regulator 198 also provides a similar output except that the output voltage is negative.

Regulator 220 is adjusted for an output of approximately 12 volts with a voltage divider circuit that provides an appropriate reference voltage on the ADJ terminal of regulator 220. The voltage divider is created using three resistor connected in series; 240 ohm resistor 222, 1 Kohm resistor 224 and 1.5 Kohm resistor 226. The three resistors in series are connected between the outputs of regulators 220 and 198. A second set of in series resistors of the same values are also connected between the outputs of regulators 220 and 198. These resistors consist of 240 ohm resistor 196, 1 Kohm resistor 194 and 1.5 Kohm resistor 192. These resistors provide an appropriate reference voltage on the ADJ terminal of regulator 198 so that its output is approximately −12 volts.

To quickly dissipate power through the regulators 220 and 198 upon removal of the 18 VAC track voltage diodes 184 and 186, respectively, are placed in parallel with regulators 198 and 220. Each diode 184 and 186 has its cathode connected to the input of its respective regulator and its anode connected to the output of the same regulator. If 18 VAC is removed from the inputs of either regulator any voltage greater than a diode drop will forward bias either diode 184 of 186 providing an input for the respective regulator until the charge is fully dissipated.

In order to provide the appropriate DC offset voltage to the QSI or compatible sound board each regulator 198 and 220, respectively, must be independently controlled in response to a command from the user to sound the bell or blow the whistle of the model train engine. Providing the "brains" to model train sound board interface 120 for controlling the bell and whistle sound effects (among other things) is microcontroller 122. In the preferred embodiment, microcontroller 122 is a PIC12C508 8-pin, 8-bit CMOS microcontroller manufactured by Microchip Technology, Inc. The PIC12C508 microcontroller is a low-cost, high performance, fully static, EPROM/ROM-based circuit that employs a RISC architecture with only 33 single word/single cycle instructions. The PIC12C508 is preferred due to its small size, versatility and its serial input port. It should be noted that any type of microprocessor/microcontroller could be used in model train sound board interface 120. Microprocessors and microcontrollers come in all different shapes, sizes and packages, all with various different features. The Applicant does not intend the present invention to be limited to the particular microcontroller disclosed in and discussed in relation to the preferred embodiment. One of ordinary skill in the art would know that any number of different microprocessors and/or microcontrollers could be substituted.

Microcontroller 122 includes a number of input/output ports that are unused in the current preferred embodiment. To prevent noise problems the unused input/output ports are tied high through 10 Kohm pull-up resistors 234, 236 and 238. To provide high frequency decoupling for the +5 VDC power supplied to microcontroller 122 a 0.1 uF capacitor 146 is connected across the +5 VDC and ground connections of microcontroller 122, preferably in close relation to the power inputs. The remaining three input/output ports are used as serial port 168, bell output 212 and whistle output 214. In their normally OFF state, bell output 212 and whistle output 214 are in a low state which prevents optocouplers 176 and 228 from activating. As long as optocouplers 176 and 228 remain off the QSI or compatible sound board (not shown) coupled to connectors 156 and 158 will not detect a DC offset voltage indicating that either the bell or whistle of the model train engine has been requested. While any number of optocouplers can be used, optocouplers 176 and 228 in the preferred embodiment are H11G3 high voltage photodarlington optocouplers manufactured by QT Optoelectronics. Each optocoupler 176 and 228 includes a GaAs infrared emitting diode coupled with a silicon darlington connected phototransistor. The cathode of each infrared emitting diode (light emitting diode or LED) is connected to the DC ground of interface 120. The anode of the LED of optocoupler 228 is connected to bell output 212 of microcontroller 122 through 680 ohm current limiting resistor 230. The anode of the LED of optocoupler 176 is connected to whistle output 214 of microcontroller 122 through 680 ohm current limiting resistor 232.

In operation, the QSI or compatible sound board is supplied with the necessary plus or minus DC offset when microcontroller 122 turns the corresponding optocoupler 176 or 228 on thereby effectively removing the 1 Kohm resistor 194 or 224, respectively, from the circuit causing a change in the reference voltage supplied to the ADJ terminal of the regulators 198 or 220. For example, when a user sends the command to sound the bell from transmitter 114, R2LC receiver 130 receives the command and then outputs a digital serial data stream into serial port 168 of microcontroller 122. In turn, microcontroller 122 interprets the serial data stream to determine what actions to take. Upon determining that the user has requested that the bell sound microcontroller 122 changes bell output 212 to a high state which causes the LED of optocoupler 228 to emit light. This causes the phototransistor within optocoupler 228 to conduct from its collector to its emitter. The collector and the emitter of optocoupler 228 are connected in parallel with resistor 224 so that when optocoupler 228 is activated, resistor 224 is shorted out of the voltage divider used to set the ADJ terminal of regulator 220. When resistor 224 is shorted from the voltage divider the new voltage present at the ADJ terminal causes the output voltage of regulator 220 to change to approximately half its normal value or approximately +6 volts. During this state the peak-to-peak AC voltage between AC 274 and ACG 276 ends up appearing to the QSI or compatible sound boards as a DC offset due to the unbalanced wave form which cycles between +6 and −12 VAC. This unbalanced condition is only maintained by microcontroller 122 for a brief period of time as the QSI or compatible sound boards only require a brief detection of either the positive or negative DC offset voltage. When optocoupler 228 is turned off resistor 224 is again added back into the voltage divider which sets the ADJ terminal of regulator 220 for an output voltage of 12 volts.

To initiate the whistle essentially the same operation just described takes place except that whistle output 214 goes into a high state turning optocoupler 176 on which shorts resistor 194 out of the voltage divider circuit. This causes the reference voltage at the ADJ terminal of regulator 198 to change causing the output voltage to go to −6 volts thereby creating a positive DC offset voltage indicating that the whistle sound effect is being requested. The collector and emitter of the phototransistor within optocoupler 176 are connected in parallel with resistor 194 through OTT/QSI select switches 178 and 188, which will be explained shortly. As long as OTT/QSI select switches 178 and 188 are in the QSI position (or left hand position when viewing the schematic of FIG. 4), optocoupler 176 is coupled to the voltage divider of regulator 198. The positive and negative DC offset voltages provided to the QSI or compatible sound boards allow the TRAINMASTER Command Control system to be used to control model train engines not originally configured accordingly. Model train sound board interface 120 provides the link that makes these varying industry standards compatible to the advantage of train enthusiasts everywhere.

As discussed earlier, model train sound board interface 120 also provides universal compatibility in that it also works with at least two other industry standard sound boards; LIONEL'S RailSounds and OTT Machine Services sound boards. To provide for compatibility with sound boards manufactured by OTT Machine Services (hereinafter "OTT") terminal block 170 is provided. When both OTT/QSI select switches 178 and 188 are in the OTT select position (or right hand position when viewing the schematic of FIG. 4), pulse count connections 172 and 174 are connected across the phototransistor of optocoupler 176. In addition, one of the connections from OTT terminal block 170 is pulse count signal 210 which is provided from the output of a half-wave rectifier made up of diodes 206 and 208. The half-wave rectifier is coupled in parallel with motor 162 and provides a positive pulse for each half cycle of AC voltage provided to motor 162 during operation, regardless of motor direction.

The reason for this arrangement is that OTT sound boards only require a digital pulse representing the speed of the motor 162 of the model train engine and a single pulse of different lengths to determine whether the bell or whistle has been requested. When used in conjunction with OTT sound boards, whistle output 214 (also noted as "horn" on the schematic of FIG. 4) is activated by microcontroller 122 for different lengths of time depending on whether the user requests the bell or whistle functions through transmitter 114. The OTT sound boards then supply a signal to the collector of the phototransistor of optocoupler 176 through OTT terminal block 170 and monitors when and how long a voltage is present at the emitter of the phototransistor. Depending on the length of time a voltage is present at the emitter, the OTT sound board either emits sound effects representing a bell or a whistle. The other sound effect generated by the OTT sound boards is an engine sound that varies depending on the speed motor 162 is rotating. The OTT sound boards monitor pulse count signal 210 and the number of pulses in a predetermined period of time in order to determine the speed of motor 162. The OTT sound board then generates an appropriate engine sound effect based on the speed of motor 162.

The other dominant sound board in the industry is the LIONEL product. To accommodate the RailSounds sound board, model train sound board interface 120 includes RS connector 160 having three connections. RS connector 160 includes terminals for RED 18 VAC 164, neutral and serial port 168. The RailSounds sound board takes all of its commands in the form of a digital, serial data stream and therefore only requires a power source (18 VAC) and input from serial port 168. The RailSounds sound board then regulates the 18 VAC power and interprets the serial data on its own and produces the requested sound effects.

Microcontroller Embedded Software Routine

In order to interpret and control the various functions performed by model train sound board interface 120, microcontroller 122 must be programmed accordingly. The computer program is stored in non-volatile program memory, such as ROM or EPROM-based memory, which in the preferred embodiment is incorporated within microcontroller 122.

Figure 5:
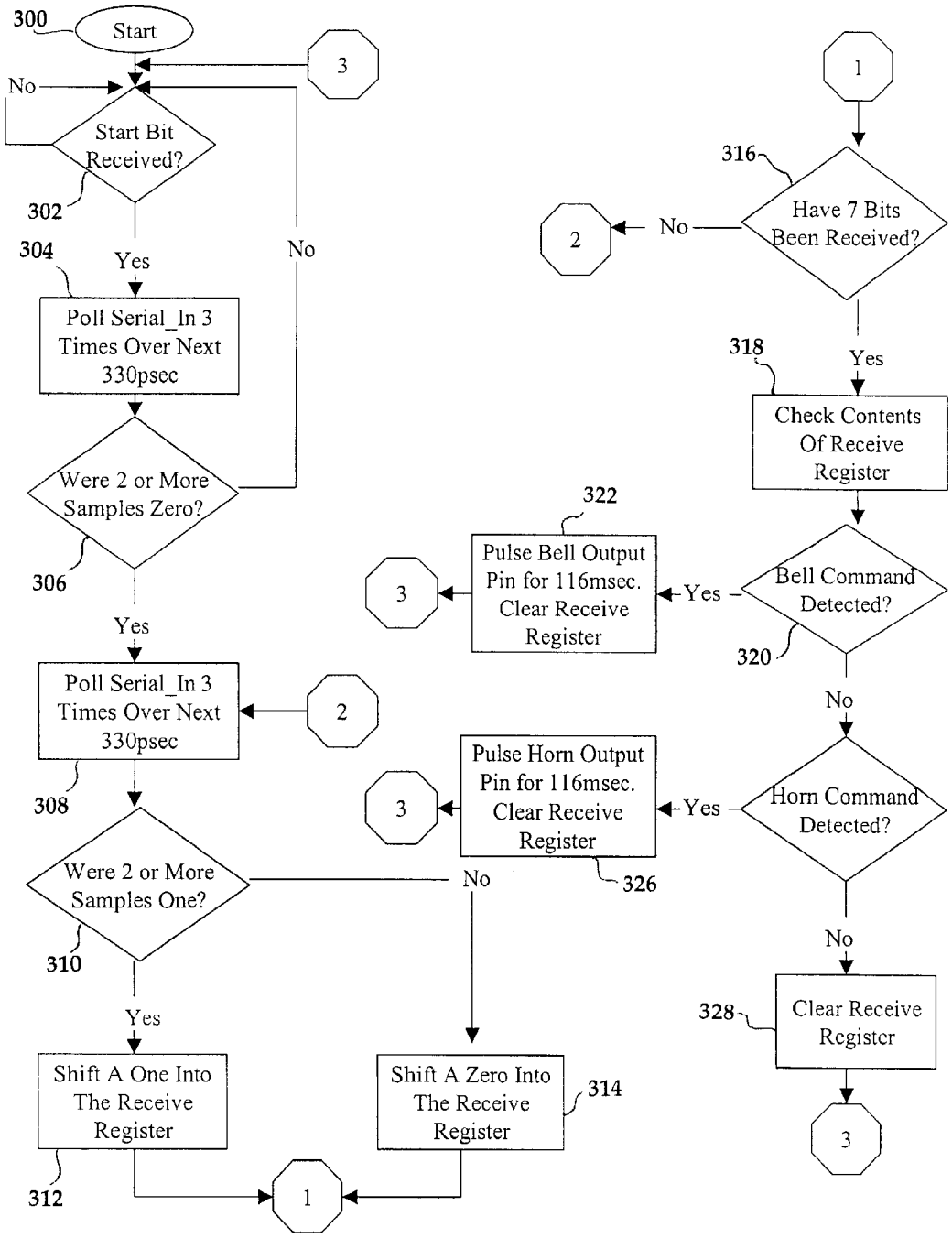
FIG. 5 is a flowchart of the computer program used to control the present invention.

FIG. 5 is a flowchart of the computer program (software) used to control the present invention. Upon applying power to model train sound board interface 120, the computer program starts 300 by initializing microcontroller 122 and then immediately begins checking to see if a start bit has been received 302 on serial port 168. If no start bit is detected the computer program will continuously loop checking to see if a start bit has been received 302. Once a start bit has been received the computer program polls serial port 168 a predetermined number of times over a set period of time 304. In one embodiment, serial port 168 is polled three times over a 330 uSec period. Next, the computer program checks to see if there were two or more sample zeros 306 received on serial port 168. If not, the computer program loops back and checks to see if a start bit has been received 302. If two or more samples were zero then serial port 168 is again polled three times over a 330 uSec period 308 and serial port 168 is checked for two or more sample ones 310. If a one is detected it is then shifted into the receive register 312 embedded within microcontroller 122. If a one is not detected then a zero is shifted into the receive register 314.

This process repeats until 7 bits have been received 316. Once 7 bits have been received 316 the computer program checks the contents of the receive register 318 and determines whether the bell command was detected 320. If the bell command was detected 320 then the computer program pulses bell output 212 for approximately 116 mSec thereby triggering the mechanisms that allow the particular sound board to trigger the bell sound effect. Once the bell output 212 is pulsed the computer program clears the receive register and goes back to the start 300 beginning the process over again looking for the next command. If the bell command was not detected 320 then the computer program looks to see if the horn or whistle command was detected 324. If so then the computer program pulses whistle output 214 for approximately 116 mSec thereby triggering the mechanisms that allow the particular sound board to trigger the whistle sound effect. Once the whistle output 214 is pulsed the computer program clears the receive register and goes back to the start 300 beginning the process over again looking for the next command. If neither the bell 320 or the whistle (or horn) 324 commands are detected then the computer program goes back to the start 300 and continues to looking for the next command.

The computer program briefly described in relation to FIG. 5 is only a simplified explanation of how microcontroller 122 functions. One of ordinary skill in the art would understand and know that there are any number of ways to implement the detection of logic states, to interpret serial data and to cause input/output ports to react. The present invention is not limited to nor does the Applicant intend to be limited to the specific functions set forth in FIG. 5. Additional functions, both in software and hardware, can be added to the model train sound board interface 120 to provide additional versatility and/or compatibility with other or future designed sound boards.

Although the principles, preferred embodiments and preferred operation of the present invention have been described in detail herein, this is not to be construed as being limited to the particular illustrative forms disclosed. They will thus become apparent to those skilled in the art that various modifications of the preferred embodiments herein can be made without departing from the spirit or scope of the invention as defined by the appended claims.

What is claimed is:

1. An apparatus for after market attachment to and use in making a model train engine compatible with a command control transmitter and command control receiver, said apparatus comprising:

a control system selectively mounted within the model train engine and connected to selectively control functions associated with the model train engine, the control system comprising means for interpreting commands received by said command control receiver from said command control transmitter; and a sound board controller for controlling a sound board in response to said commands sent by said command control transmitter.

2. An apparatus as recited in claim 1, wherein said sound board controller comprises:

direct current voltage offset circuit, wherein said directed current voltage offset circuit creates positive or negative direct current voltage offsets corresponding to commands received from said command control transmitter to control said aftermarket sound board if said sound board operates from DC offset voltages;

a period/pulse circuit, wherein said period/pulse circuit creates pulse counts corresponding to commands received from said command control transmitter to control said sound board if said sound board operates from pulse counts; and a serial data circuit, wherein said serial data circuit creates digital commands corresponding to commands received from said command control transmitter to control said sound board if said sound board operates from digital commands.

3. An apparatus as recited in claim 1, further comprising:

a motor driver coupled to an electric motor of said model train engine, wherein said motor driver regulates the speed and direction of said electric motor.

4. An apparatus as recited in claim 3, wherein said motor driver comprises a four triac H-bridge circuit, wherein each of said four triacs is optoelectronically controlled and isolated.

5. An apparatus as recited in claim 4, wherein said four triac H-bridge is configurable for operation of said model train engine from both AC and DC power supplies.

* * * * *